US010679458B2

(12) United States Patent
Oyama et al.

(10) Patent No.: US 10,679,458 B2
(45) Date of Patent: Jun. 9, 2020

(54) INFORMATION PROCESSOR AND GAME CONTROL METHOD

(71) Applicant: Universal Entertainment Corporation, Tokyo (JP)

(72) Inventors: Masaki Oyama, Tokyo (JP); Atsushi Kumita, Tokyo (JP); Toshikazu Jinnouchi, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 0 days.

(21) Appl. No.: 16/143,296

(22) Filed: Sep. 26, 2018

(65) Prior Publication Data

US 2019/0096163 A1 Mar. 28, 2019

(30) Foreign Application Priority Data

Sep. 27, 2017 (JP) ..... 2017-187146

(51) Int. Cl.
*G07F 17/32* (2006.01)
*G07F 17/34* (2006.01)

(52) U.S. Cl.
CPC ..... *G07F 17/3211* (2013.01); *G07F 17/34* (2013.01)

(58) Field of Classification Search
None
See application file for complete search history.

(56) References Cited

U.S. PATENT DOCUMENTS

2008/0058082 A1* 3/2008 Kido ..... G07F 17/34 463/20
2008/0064466 A1* 3/2008 Saito ..... G07F 17/34 463/16
2019/0091583 A1* 3/2019 Oyama ..... A63F 13/795
2019/0095971 A1* 3/2019 Oyama ..... G06Q 30/0623
2019/0096159 A1* 3/2019 Oyama ..... G07F 17/323

* cited by examiner

*Primary Examiner* — Ronald Laneau
(74) *Attorney, Agent, or Firm* — Polsinelli PC

(57) ABSTRACT

An information processor of the present invention comprises a display for displaying a symbol display area in which a plurality of symbols can be displayed, and a controller programmed to execute the following processes (1a) to (1c): (1a) a process of determining a plurality of symbols to be displayed in the symbol display area by random determination, (1b) a process of displaying the plurality of symbols determined by the process of (1a) in the symbol display area, and (1c) a process of displaying a character corresponding to a specific symbol outside the symbol display area in a case where the specific symbol is displayed among the plurality of symbols displayed in the symbol display area.

8 Claims, 13 Drawing Sheets

FIG.6

SYMBOL COLUMNS OF VIDEO REEL

| | REEL 1 | REEL 2 | REEL 3 | REEL 4 | REEL 5 |
|---|---|---|---|---|---|
| 0 | HEART | 9 | CHERRY | 9 | KING |
| 1 | CHERRY | JACK | KING | JACK | ACE |
| 2 | 7 | HEART | 9 | WILD | BELL WILD |
| 3 | JACK | 7 | ACE | 9 | |
| 4 | KING | 10 | BELL | JACK | |
| 5 | WATERMELON | 9 | 10 | HEART | WATERMELON |
| 6 | 10 | ACE | WATERMELON | KING | QUEEN |
| 7 | BELL | BELL | 10 | JACK | HEART |
| 8 | JACK | JACK | CHERRY | 10 | JACK |
| 9 | 9 | WATERMELON | 10 | BELL WILD | 9 |
| 10 | ACE | 9 | WATERMELON | | CHERRY |
| 11 | JACK | CHERRY | JACK | | 10 |
| 12 | ACE | ACE | KING | ACE | 7 |
| 13 | BELL | QUEEN | HEART | 9 | ACE |
| 14 | KING | 9 | 7 | QUEEN | JACK |
| 15 | QUEEN | KING | 10 | 7 | 9 |
| 16 | HEART | WILD | 7 | CHERRY | KING |
| 17 | JACK | ACE | QUEEN | HEART | JACK |
| 18 | 10 | QUEEN | 10 | ACE | ACE |
| 19 | 9 | WATERMELON | HEART WILD | KING | BELL |
| 20 | 9 | 10 | | WATERMELON | QUEEN |
| 21 | CHERRY | 9 | | 10 | ACE |
| 22 | JACK | QUEEN | CHERRY | BELL | 9 |
| 23 | 10 | CHERRY | ACE | 9 | WATERMELON |
| 24 | WATERMELON | HEART WILD | QUEEN | 10 | 10 |
| 25 | JACK | | JACK | CHERRY | ACE |
| 26 | | | QUEEN | KING | CHERRY |
| 27 | | 10 | HEART | HEART WILD | QUEEN |
| 28 | | BELL | BELL WILD | | ACE |
| 29 | | ACE | | | HEART WILD |
| 30 | | 9 | | QUEEN | |
| 31 | | 7 | | BELL | |
| 32 | | BELL WILD | | 9 | ACE |
| 33 | | | | ACE | KING |
| 34 | | | | | |

FIG.7

SYMBOL COMBINATION TABLE

| SYMBOL | GRAPHICS | 1 | 2 | 3 | 4 | 5 |
|---|---|---|---|---|---|---|
| WILD | | 0 | 0 | 0 | 0 | 0 |
| 7 | | 0 | 0 | 50 | 300 | 1000 |
| HEART | | 0 | 0 | 35 | 200 | 800 |
| BELL | | 0 | 0 | 30 | 100 | 500 |
| WATERMELON | | 0 | 0 | 20 | 50 | 300 |
| CHERRY | | 0 | 0 | 15 | 35 | 300 |
| ACE | A | 0 | 0 | 10 | 30 | 200 |
| KING | K | 0 | 0 | 10 | 20 | 200 |
| QUEEN | Q | 0 | 0 | 10 | 15 | 100 |
| JACK | J | 0 | 0 | 10 | 15 | 100 |
| TEN | 10 | 0 | 0 | 5 | 15 | 100 |
| NINE | 9 | 0 | 0 | 5 | 10 | 100 |

INFORMATION PROCESSOR AND GAME CONTROL METHOD

CROSS-REFERENCE TO RELATED APPLICATION

This Application is Entitled to the benefit of Japanese Pat. App. No. 2017-187146, filed on Sep. 27, 2017.

BACKGROUND OF THE INVENTION

1. Field of Invention

The present invention relates to an information processor and a game control method.

2. Description of Related Art

In the related art, there are various types of games to be performed by a home type game console device, a game device installed in a facility, or an information processor such as a smart phone. For example, there are a slot game in which the slot game is played by betting various gaming mediums (currency in a game or the like) and a slot game in which a benefit (payout) is given based on a the gaming mediums and a combination of symbols (game result) displayed on a screen. In such a game, it is based on enjoying by repeating a game (unit game) of one cycle from the start of the game until obtaining the game result (see Patent Document 1 (International Publication No. WO2016/136749A1)).

In the slot game, a plurality of types of symbols are prepared on the screen, and it is general that benefits are given by the combination of the same type of symbols.

BRIEF SUMMARY OF THE INVENTION

However, even though different types of symbols are similar in appearance shape and color, there is a case in which it is difficult to distinguish at a glance. For example, if they are a symbol of "apple" and a symbol of "strawberry", the colors are different but the shapes are similar. Also, if they are a symbol of "apple" and a symbol of "strawberry", the shapes are different, but the colors are similar.

In addition, as in the slot game of Patent Document 2 (U.S. Pat. No. 9,721,436), mermaid symbols are consecutively arranged in the reel row, and the consecutively arranged mermaid symbols may be displayed on the screen as one mermaid image. At this time, if the mermaid symbols arranged consecutively on the reel row are not all displayed on the screen but only half are displayed, only the image of the upper body or the lower body of the mermaid will be displayed on the screen. Then, for a player, there is a case where it can not be distinguished at a glance whether the mermaid symbol is really a symbol of a mermaid, another symbol of a human, or a symbol of a fish.

It is therefore an object of the present invention to provide an information processor, a game program, and a game control method capable of causing a player to recognize the types of symbols displayed on a screen at a glance.

The present invention relates to an information processor comprising:

a display for displaying a symbol display area capable of displaying a plurality of symbols, and a controller programmed to execute:

(1a) a process of determining a plurality of symbols to be displayed in the symbol display area by random determination, (1b) a process of displaying the plurality of symbols determined by the process of (1a) in the symbol display area, (1c) a process of displaying a character corresponding to a specific symbol outside the symbol display area in a case where the specific symbol is displayed among the plurality of symbols displayed in the symbol display area.

A plurality of symbols determined by random determination are displayed in the symbol display area displayed on the display. At this time, when a specific symbol is rearranged among a plurality of displayed symbols, there is a cases where it is not known at a glance whether or not a specific symbol is displayed among a plurality of symbols. According to the above configuration, by displaying a character corresponding to a specific symbol outside the symbol display area where a plurality symbols are displayed, it is possible for a player to recognize at a glance that a specific symbol is displayed in the symbol display area.

Thereby, it allows the player to smoothly execute a game including the series of processes, so there is an advantage that the possibility of being able to induce the player to execute the game can be increased.

In addition, according to another aspect of the present invention, there is provided an information processor comprising:

a display for displaying a symbol display area in which a plurality of symbols can be rearranged, the symbol display areas being arranged in a matrix so that a plurality of columns and a plurality of rows cross each other, a storage device for storing a random determination table in which the plurality of symbols are arranged for each column, and a controller programmed to execute:

(2a) a process of determining a plurality of symbols to be displayed in the symbol display area for each column by random determination based on the random determination table, (2b) a process of scrolling the plurality of symbols determined by the process of (2a) along each column of the symbol display area and then rearranging the plurality of symbols sequentially in the each column, (2c) a process of displaying a character corresponding to a specific symbol at the upper of the column where the specific symbol is rearranged and outside the symbol display area, when the specific symbol is rearranged, as a result of a determination in which it is determined whether or not the specific symbol is rearranged among a plurality of symbols corresponding to the rearranged number of rows for each column of the symbol display area in the process of (2b).

A plurality of symbols determined by random determination are displayed in a symbol display area arranged in a matrix so that a plurality of columns and a plurality of rows cross each other. At this time, when a specific symbol is rearranged among a plurality of displayed symbols, there is a cases where it is not known at a glance whether or not a specific symbol is displayed among a plurality of symbols. According to the above configuration, it is determined whether or not a specific symbol is rearranged among a plurality of rearranged symbols for each column, and as a result of the determination, if the specific symbol is rearranged, a character corresponding to the specific symbol is displayed at the upper of the column where the specific symbol is rearranged and outside the symbol display area. Thereby, it is possible to cause a player to recognize at a glance which of the columns the specific symbol is rearranged, depending on whether or not the character is displayed.

Thereby, it allows the player to smoothly execute a game including the series of processes, so there is an advantage that the possibility of being able to induce the player to execute the game can be increased.

Further, in the information processor of the present invention, in the random determination table, among a plurality of symbols arranged for each column, a plurality of the specific symbols are arranged consecutively across a plurality of rows in the column, and the plurality of specific symbols arranged consecutively constitute one image corresponding to the specific symbol.

According to the above configuration, when all of the plurality of consecutively arranged specific symbols are rearranged in the columns of the symbol display area in the random determination table, by displaying one image composed of a plurality of specific symbols rearranged consecutively in the symbol display area, it is possible to clearly appeal to the player that the specific symbol has been rearranged.

On the other hand, all of the plurality of specific symbols arranged consecutively are not rearranged in the columns of the symbol display area, but only a part of the specific symbols (fewer than the number of consecutively arranged specific symbols) is rearranged, only a part of the image constituted by a plurality of consecutive specific symbols is displayed in the symbol display area. As a result, it may be impossible to clearly appeal to the player that specific symbol has been rearranged. However, in the above configuration, the character corresponding to the specific symbol is displayed at the upper of the column where the specific symbol is rearranged and outside the symbol display area. Thereby, even if only a part of the image constituted by a plurality of consecutive specific symbols is displayed in the symbol display area, with the display of the character corresponding to the specific symbol, it is possible to appeal to the play that the specific symbol has been rearranged.

Further, in the information processor of the present invention, there are a plurality of types of the specific symbols, there are a plurality of types of the characters, the type of the character corresponds to the type of the specific symbol.

According to the above configuration, it is possible for the player to recognize at a glance that on which column which type of specific symbol is rearranged by displaying the type of the character.

In addition, the present invention provides a game control method comprising the steps of:

(3a) determining a plurality of symbols for each column to be displayed in a display area in which the plurality of symbols are rearranged and which is arranged in a matrix such that a plurality of columns and a plurality of rows cross each other, based on random determination of a random determination table in which a plurality of symbols are arranged for each column, (3b) scrolling the plurality of symbols determined by the step of (3a) along each column of the symbol display area and then rearranging the plurality of symbols sequentially in the each column, (3c) displaying a character corresponding to a specific symbol at the upper of the column where the specific symbol is rearranged and outside the symbol display area, when the specific symbol is rearranged, as a result of a determination in which it is determined whether or not the specific symbol is rearranged among a plurality of symbols corresponding to the rearranged number of rows for each column of the symbol display area in the step of (3b).

A plurality of symbols determined by random determination are displayed in a symbol display area arranged in a matrix so that a plurality of columns and a plurality of rows cross each other. At this time, when a specific symbol is rearranged among a plurality of displayed symbols, there is a cases where it is not known at a glance whether or not a specific symbol is displayed among a plurality of symbols. According to the above method, it is determined whether or not a specific symbol is rearranged among a plurality of rearranged symbols for each column, and as a result of the determination, if the specific symbol is rearranged, a character corresponding to the specific symbol is displayed at the upper of the column where the specific symbol is rearranged and outside the symbol display area. Thereby, it is possible to cause a player to recognize at a glance which of the columns the specific symbol is rearranged, depending on whether or not the character is displayed.

Thereby, it allows the player to smoothly execute a game including the series of steps, so there is an advantage that the possibility of being able to induce the player to execute the game can be increased.

In addition, the present invention provides a non-temporary recording medium storing a game program executed by a computer of an information processor, the game program controlling the computer to perform:

(4a) a process of determining a plurality of symbols for each column to be displayed in a display area in which the plurality of symbols are rearranged and which is arranged in a matrix such that a plurality of columns and a plurality of rows cross each other, based on random determination of a random determination table in which a plurality of symbols are arranged for each column, (4b) a process of scrolling the plurality of symbols determined by the process of (4a) along each column of the symbol display area and then rearranging the plurality of symbols sequentially in the each column, (4c) a process of displaying a character corresponding to a specific symbol at the upper of the column where the specific symbol is rearranged and outside the symbol display area, when the specific symbol is rearranged, as a result of a determination in which it is determined whether or not the specific symbol is rearranged among a plurality of symbols corresponding to the rearranged number of rows for each column of the symbol display area in the process of (4b).

A plurality of symbols determined by random determination are displayed in a symbol display area arranged in a matrix so that a plurality of columns and a plurality of rows cross each other. At this time, when a specific symbol is rearranged among a plurality of displayed symbols, there is a cases where it is not known at a glance whether or not a specific symbol is displayed among a plurality of symbols. According to the above method, it is determined whether or not a specific symbol is rearranged among a plurality of rearranged symbols for each column, and as a result of the determination, if the specific symbol is rearranged, a character corresponding to the specific symbol is displayed at the upper of the column where the specific symbol is rearranged and outside the symbol display area. Thereby, it is possible to cause a player to recognize at a glance which of the columns the specific symbol is rearranged, depending on whether or not the character is displayed.

Thereby, it allows the player to smoothly execute a game including the series of processes, so there is an advantage that the possibility of being able to induce the player to execute the game can be increased.

The present invention can provide an information processor and a game control method capable of causing a player to recognize the types of symbols displayed on a screen at a glance.

BRIEF DESCRIPTION OF THE DRAWINGS

FIG. 6 is an illustrative view of symbol columns of video reels of the slot game.

FIG. 7 is an illustrative view of a symbol combination table of the slot game.

DETAILED DESCRIPTION OF THE PREFERRED EMBODIMENT (Embodiments)

The information processor of the present invention will be described based on the drawings.

The game executed in the present embodiment can be executed as application software (program, game data) by being installed in a portable information processor such as a smart phone, a portable computer, a laptop computer, a notebook computer, a tablet type personal computer, a handheld type personal computer, and a PDA (Personal Data Assistant). The application software for executing this game is downloaded from a server (with reference to FIG. 2) or the like by communication means and stored in a storage device in the information processor. Wherein, the communication means may be a bidirectional communication path such as the Internet or a cable television, or may be a broadcast that transmits information only in one direction.

In addition, the application software for executing the game may also be stored in a recording medium such as a floppy disk, a CD-ROM, a DVD-ROM, an MO (magneto-optical disk), a flash memory or the like, and read out from the recording medium as necessary and then installed in the storage device in the information processor.

In the present embodiment, as the information processor, the smartphone 1 shown in FIG. 1 will be described as an example. In addition, in the following description, the smartphone 1 will be described, but the process and operation of the smartphone 1 can be replaced with the invention of a program or game control method.

(Online)

Figure 2:
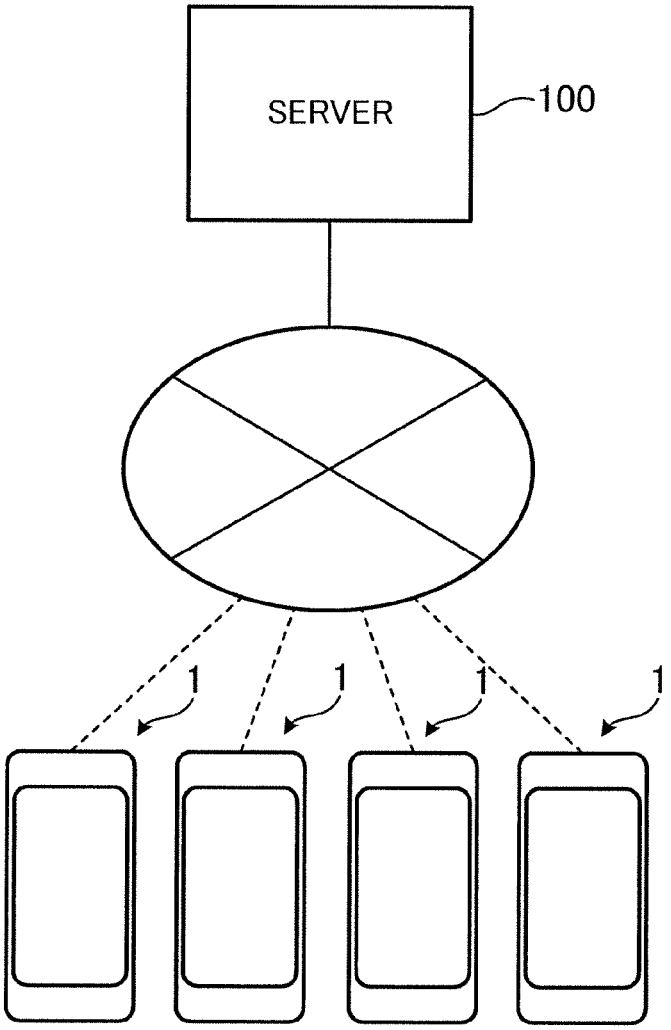
FIG. 2 is an illustrative view of a network environment between the smartphone and a server.

In addition, the game executed in the present embodiment is a slot game and is executed as an online game. Specifically, as shown in FIG. 2, a server 100 managed by a slot game operating organization and smartphones 1 operated by a large number of players are connected via a computer network (Internet).

In this way, the slot game is executed as online. As a result, the player can download the slot game application software from the server 100, install it in the smartphone 1, and execute the slot game. Further, in the server 100 (management system), exchange of credits possessed by the player (out-of-game currency which can be used outside the game) to in-game currency (coins as gaming mediums) usable in the slot game and the in-game currency possessed by the player can be managed.

(Configuration of Smartphone 1)

Figure 3:
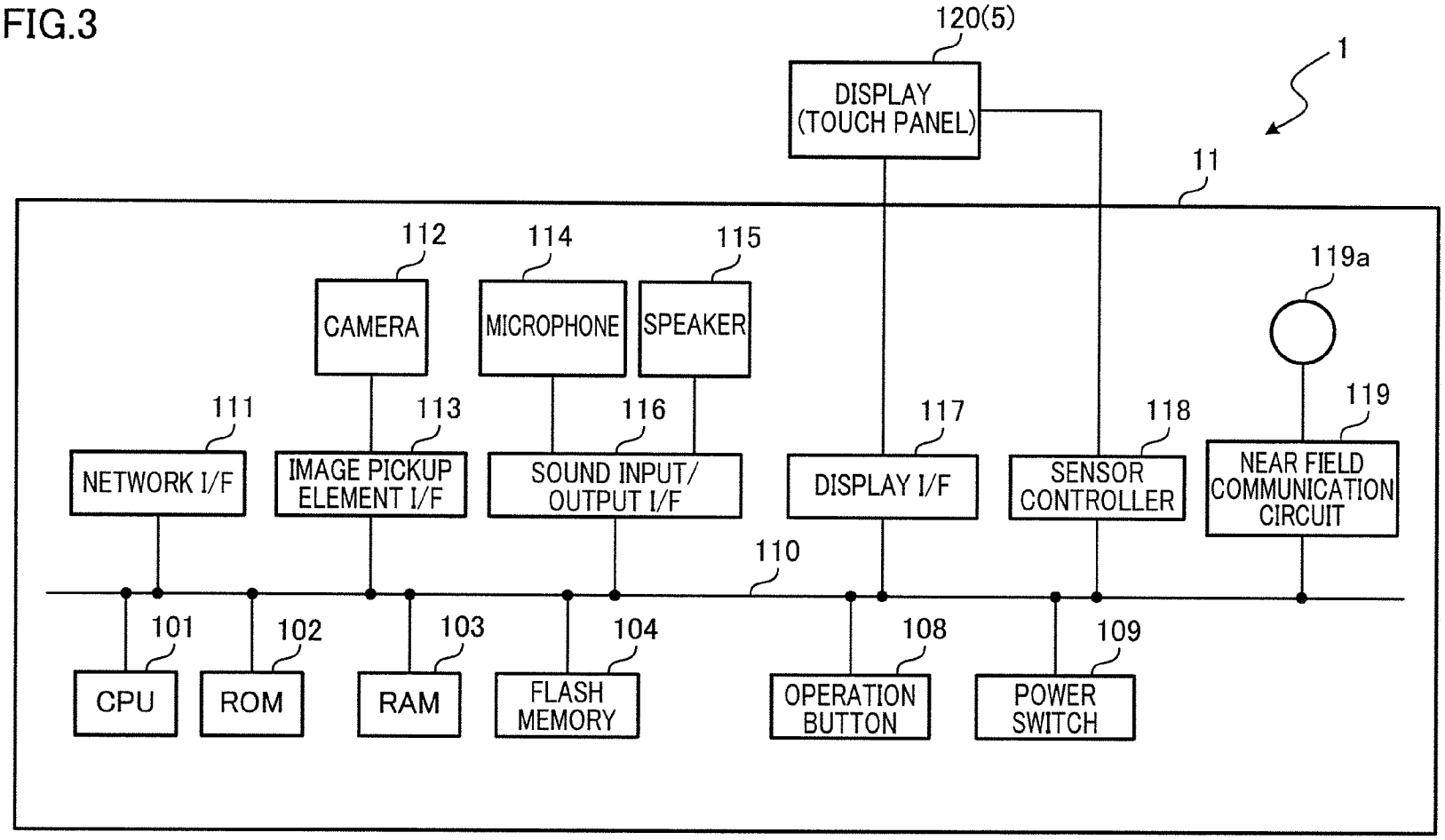
FIG. 3 is a block diagram showing an electric configuration of the smartphone (the information processor).

As shown in FIG. 3, the smartphone 1 includes a CPU 101, a ROM 102, a RAM 103, a flash memory 104, an operation button 108, a power switch 109, a bus line 110, a network I/F 111, a camera 112, an image pickup element I/F 113, a microphone 114, a speaker 115, a sound input/output I/F 116, a display I/F 117, a sensor controller 118, a short-range communication circuit 119, and an antenna 119*a* of the short-range communication circuit 119 provided in a cabinet 11. In addition, on the front surface of the cabinet 11, the display 120 having a touch panel 5 (input unit) is installed.

The display 120 is configured to display an image. As a display method of the display 120, various display methods such as a liquid crystal method, an organic electroluminescence method, a CRT (Cathode Ray Tube) method, a plasma method and the like are exemplified.

The CPU (Central Processing Unit) 101 controls the overall operation of the smartphone 1. The ROM (Read Only Memory) 102 stores a program used for driving the CPU 101, such as an IPL (Initial Program Loader).

The RAM (Random Access Memory) 103 is used as a work area of the CPU 101. The flash memory 104 stores various kinds of data such as a application software (program), a communication program, an image data, and a sound data for executing the game according to this embodiment (game data necessary for a slot game such a symbol column, a symbol combination table of a video reel to be described later). The operation button 108 is a button that is operated when the smartphone 1 is initially set. The power switch 109 is a switch for switching ON/OFF of the power of the smartphone 1.

The network I/F (Interface) 111 is interface for performing a data communication with the server 100 and the like by utilizing a communication network such as the Internet. The camera 112 is a kind of built-in type image pickup unit that captures an image of a subject under the control of the CPU 101 to obtain image data. The image pickup element I/F 113 is a circuit that controls driving of the camera 112. The microphone 114 is a kind of built-in type sound collecting unit for inputting a sound. The sound input/output I/F 116 is a circuit for processing input and output of sound signals between the microphone 114 and the speaker 115 under the control of the CPU 101. The display I/F 117 is a circuit that transmits image data to the display 120 under the control of the CPU 101. The sensor controller 118 is a circuit that receives an input from the touch panel 5 provided on the display 120. The short-range communication circuit 119 is a communication circuit such as an NFC (Near Field Communication) (registered trademark), a Bluetooth (registered trademark), or the like. The bus line 110 is an address bus, a data bus, or the like for electrically connecting each component such as the CPU 101.

(Overview of Game Executed by Smartphone 1)

In the smartphone 1 having the above configuration, the CPU 101 is programmed to execute the slot game application software.

In the smartphone 1, the game application software is executed, and after the various games start effect image or the like is displayed, when a selected image to start the "slot game" is selected by the touch panel 5, the slot game is started (described in detail later). For example, when the slot game is started, as shown in FIG. 1, a slot game is executed in which a plurality of symbols are rearranged in a symbol display area 21 composed of 15 areas in a matrix of 5 rows×3 columns (described in detail later).

Note that a plurality of types of slot games to be selected may be prepared, and the rule, the payout mode, and the effect image may be different depending on the type of slot game to be executed. For example, in a certain type of "slot game", a slot game is executed in which a plurality of symbols are rearranged in a symbol display area composed of 9 areas in a matrix of 3 rows×3 columns. In this slot game, a winning is determined by a combination of symbols rearranged on a payline (winning determination) set only in the middle of the symbol display area.

Here, when starting a slot game in the present embodiment, it is basically to consume a predetermined amount of coins (gaming mediums, in-game currency) possessed by a player, and the slot game is started as the consumption of the coins. In addition, when a predetermined condition is satisfied, it is possible to start a slot game without consuming any coin (for example, a slot game can be played without consuming any coin up to a predetermined number of times a day). The coin possessed by a player is an electronic valuable information, the player accesses from the smartphone 1 to the server 100, and can exchange a credit (out-of-game currency which can be used outside a game) for the coin according to the payment method specified by the slot game operating organization. Besides, the coin possessed by a player may also be consumed as an expense in order to obtain an effect of affecting the slot game, or is consumed as an expense to change the appearance of a character that symbolizes the player, and is a wide variety to use.

In addition, the "in-game currency" is not particularly limited, and for example, when the slot game according to the present embodiment is executed by a gaming machine (slot machine) or the like installed in a hall or the like, it may be a medal, a token, an electronic money, a ticket, and the like. The ticket is not particularly limited, and a barcoded ticket may be adopted for example. Alternatively, the in-game currency may be a game point not including valuable information.

(Slot Game: Definitions)

Figure 1:
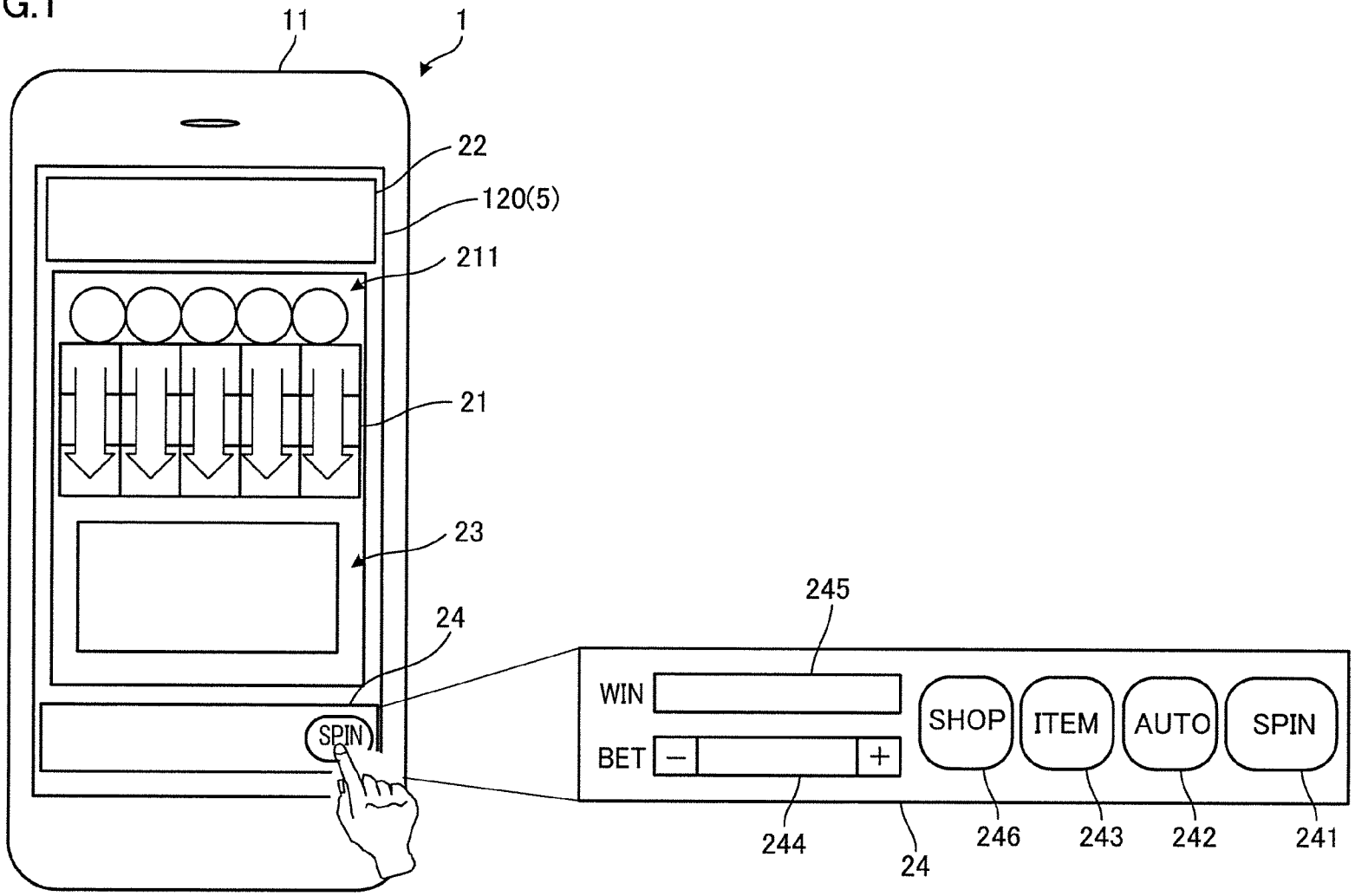
FIG. 1 is an illustrative view showing a display state of a smartphone (an information processor).

In the slot game executed in the present embodiment, a plurality of symbols are stopped and displayed (rearranged) in the symbol display area 21 after variation (scrolling video of the reel), and the benefit (such as the payout or item advantageous/disadvantageous to the player) is given by the combination of the symbols displayed in the symbol display area 21 (with reference to FIG. 1). In addition, a state in which a plurality of symbols are stop-displayed after variation in the symbol display area 21 is referred to as "rearrangement".

A "coin" may be given in the benefit given based on the combination of the symbols displayed in the symbol display area 21.

The "unit game" is a series of operations from the start of acception of a bet to a state in which a prize is established (the combination of symbols satisfies a predetermined relationship). To put it differently, the unit game includes a single bet time for accepting a bet, a single game time of rearranging stopped symbols, and a single payout time of a payout process of awarding a payout.

(Slot Game Screen)

Next, the slot game screen displayed on the display 120 of the smartphone 1 will be described.

As shown in FIG. 1, when a slot game is executed, a slot game screen is displayed on the display 120. In the slot game screen, the symbol display area 21 composed of 15 areas in a matrix of 5 rows×3 columns, a character display area 211, a game information display area 22 for displaying information (the number of coins currently possessed, etc.) increasing/decreasing with the execution of the slot game, an effect display area 23 for displaying a dynamic image, a still image, and a message associated with a game in accordance with the development of the slot game, and an operation display area 24 operated by the player for the progress of the slot game are displayed. In the operation display area 24, a spin button 241, an AUTO button 242, an ITEM button 243, a bet button 244, a WIN display unit 245, and a shop button 246 are displayed.

The touch panel 5 that transmits the slot game screen is provided on the entire surface of the display 120. The touch panel 5 makes it possible to detect the coordinate of the site touched by the player's finger or the like. Thus, for example, by touching the image of the spin button 241, one slot game (unit game) can be executed. In addition, by touching the image of the AUTO button 242, the slot game can be consecutively performed. Further, when the image of the ITEM button 243 is touched, the player can select and use the item (game effect that affects the slot game) acquired in the past. In addition, when the image of the shop button 246 is touched, it is possible to access the server 100 from the smartphone 1 and move to a shop in which the credit (out-of-game currency which can be used outside the game) can be exchanged for the coin.

(Symbol Display Area 21)

Figure 4:
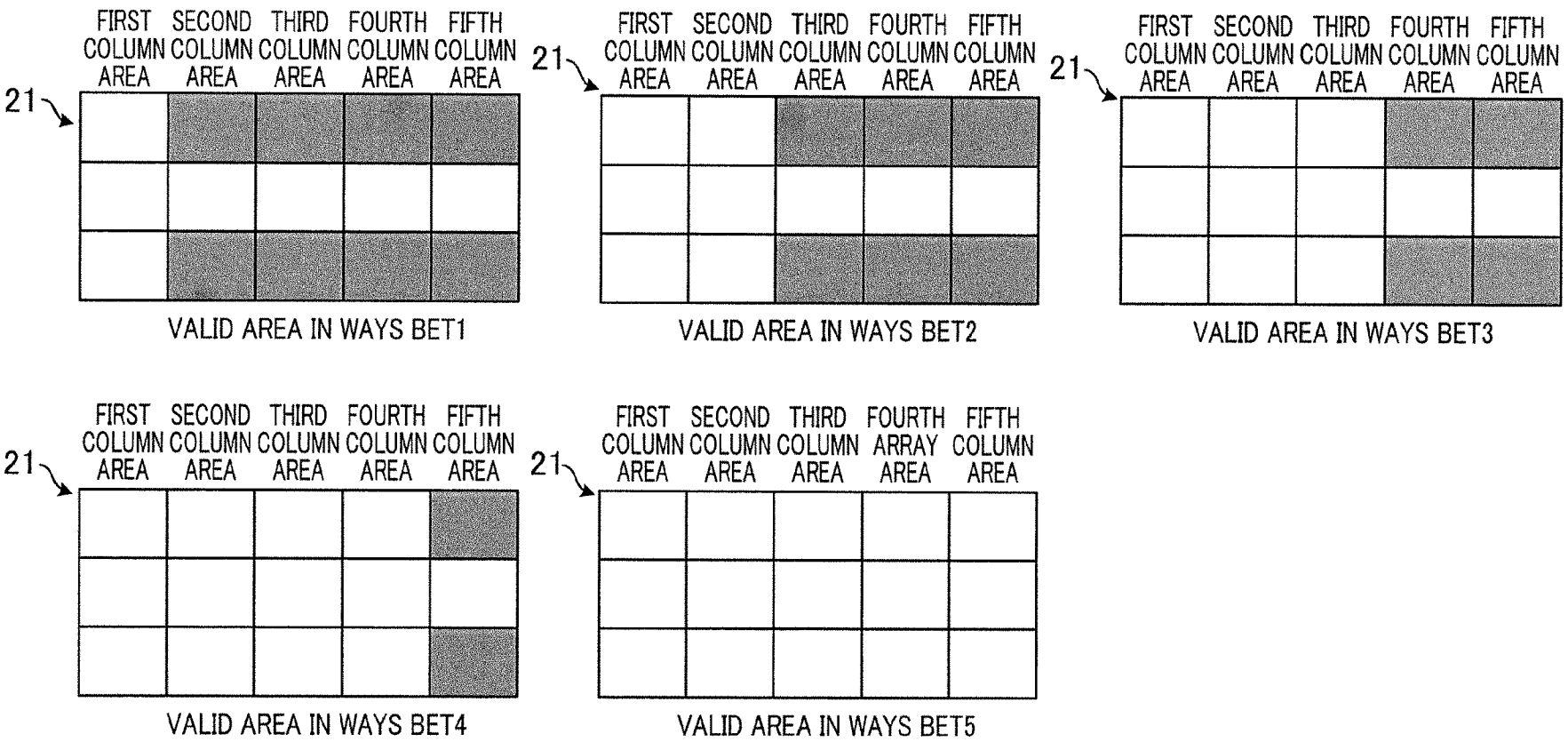
FIG. 4 is an illustrative view of an effective area of "WAYS BET" of a slot game.
Figure 5:
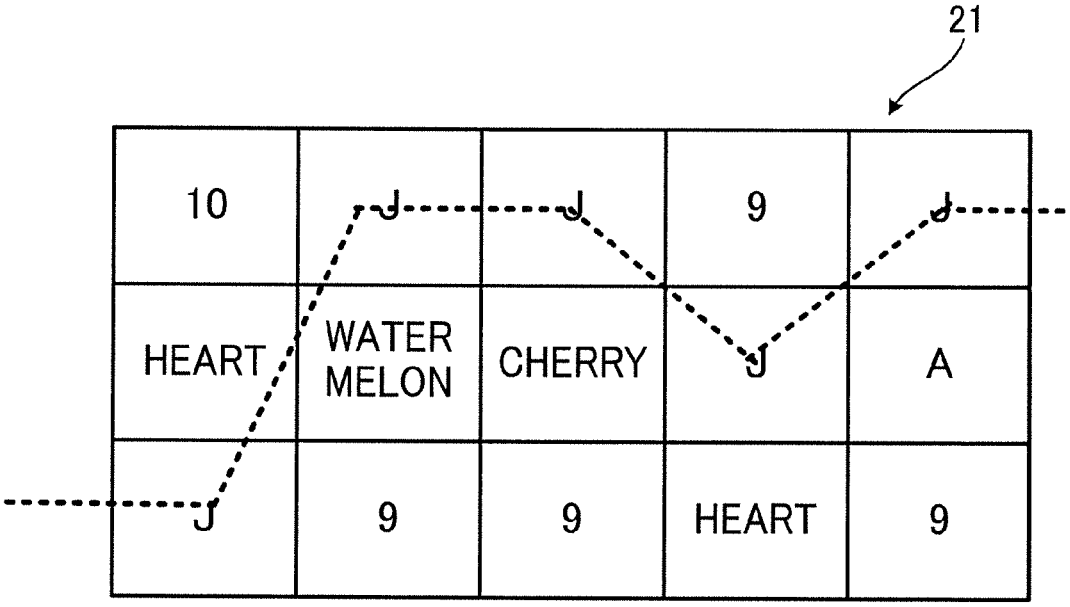
FIG. 5 is an illustrative view of a winning determination example in the "WAYS BET" of the slot game.

As described above, in the symbol display area 21 of the slot game, as shown in FIGS. 4 and 5, five column areas (the first column area to the fifth column area) each divided into three areas of an upper row, a middle row, and a lower row (three rows) are set. Also, video reels 3 (REEL 1, REEL 2, REEL 3, REEL 4, REEL 5) are displayed in the first to fifth column areas, respectively. In the video reels 3 of the slot game of the present embodiment, operations of rotating and stopping mechanical reels on which a plurality of symbols are drawn on their circumferential surfaces are represented by images. Symbol columns composed of a plurality of symbols are allocated to the video reels 3 (REEL 1, REEL 2, REEL 3, REEL 4, REEL 6) (with reference to FIG. 5).

In the symbol display area 21, the symbol columns allocated to the video reels 3 (REEL 1, REEL 2, REEL 3, REEL 4, REEL 5, REEL 6) are respectively scrolled and stopped after a lapse of a predetermined time. As a result, a part of each symbol column (three consecutive symbols) is sequentially displayed in the symbol display area 21. In the first to fifth column areas of the symbol display area 21, one symbol is allocated to each of the upper, middle, and lower areas is displayed accordingly to the video reels 3 (REEL 1, REEL 2, REEL 3, REEL 4, REEL 5). That is, in the symbol display area 21, 15 symbols of 5 columns×3 rows are displayed.

As described above, in the symbol display area 21, 15 areas are arranged in a matrix pattern so that five column areas (a plurality of columns) and three rows (a plurality of rows) of the upper row, the middle row, and the lower row cross each other.

In the slot game, the determination of winning adopts "LEFT TO RIGHT" type. First, the area as the object of the winning determination is determined from the 15 areas in 5 columns×3 rows of the symbol display area 21 by selecting five stages of the WAYS BET (WAYS BET 1, WAYS BET 2, WAYS BET 3, WAYS BET 4, WAYS BET 5) (determination of an valid area) (with reference to FIG. 4). Then, if symbols stopped in the area as the object of the winning determination are consecutively connected in a predetermined number from the first column area to the fifth column area, it becomes the winning (with reference to FIG. 5).

Wherein, the selection of five stages of WAYS BET (WAYS BET 1, WAYS BET 2, WAYS BET 3, WAYS BET 4, WAYS BET 5) is performed by touching the "+" button and "–" button (with reference to FIG. 1) of the bet button 244. In addition, one coin is required to select WAYS BET 1. Also, three coins are required to select WAYS BET 2. In addition, seven coins are required to select WAYS BET 3. In addition, to select WAYS BET 4, fifteen coins are required. In addition, to select WAYS BET 5, twenty-five coins are required.

More specifically, as shown in FIG. 4, when "WAYS BET 1" is selected, the upper row, the middle row, and the lower row of the first column area, the middle row of the second column area, the middle row of the third column area, the middle row of the fourth column area, and the middle row of the fifth column area of the symbol display area 21 become the object of the winning determination (valid). In addition, when "WAYS BET 2" is selected, the upper row, the middle row, and the lower row of the first column area, the upper row, the middle row and the lower row of the second column area, the middle row of the third column area, the middle row of the fourth column area, and the middle row of the fifth column area of the symbol display area 21 become the object of the winning determination (valid). In addition, when "WAYS BET 3" is selected, the upper row, the middle row, and the lower row of the first column area, the upper row, the middle row and the lower row of the second column area, the upper row, the middle row and the lower row of the third column area, the middle row of the fourth column area, and the middle row of the fifth column area of the symbol display area 21 become the object of the winning determination (valid). In addition, when "WAYS BET 4" is selected, the upper row, the middle row, and the lower row of the first column area, the upper row, the middle row and the lower row of the second column area, the upper row, the middle row and the lower row of the third column area, the upper row, the middle row and the lower row of the fourth column area, and the middle row of the fifth column area of the symbol display area 21 become the object of the winning determination (valid). In addition, when "WAYS BET 5" is selected, the upper row, the middle row, and the lower row of the first column area, the upper row, the middle row and the lower row of the second column area, the upper row, the middle row and the lower row of the third column area, the upper row, the middle row and the lower row of the fourth column area, and the upper row, the middle row and the lower row of the fifth column area of the symbol display area 21 become the object of the winning determination (valid).

For example, as shown in FIG. 5, when the "WAYS BET 5" is selected, all areas of the symbol display area 21 become the objects of the winning determination (validated). Then, as shown in FIG. 5, when the symbols "J: Jack" are respectively stopped in the lower row of the first column area, the upper row of the second column area, the upper row of the third columns area, the middle row of the fourth column area, the upper row of the fifth row column area, the symbols "J: Jack" are consecutively connected up to five from the first column area to the fifth column area ("LEFT TO RIGHT") to establish one winning. As described above, in the "LEFT TO RIGHT" type, even if the symbols are stopped in a wild disorder at a glance, if they are connected consecutively from the first column area to the fifth column area, the winning is determined. In addition, in the slot game of the present embodiment, the "LEFT TO RIGHT" type is adopted, but adopting a line type in which a line formed by connecting only the middle row of the column area of each column is a winning line is also possible. Further, a scatter type may be adopted for determining the winning according to the number of symbols of the same type displayed in the symbol display area 21.

(Character Display Area 211)

Figure 11:
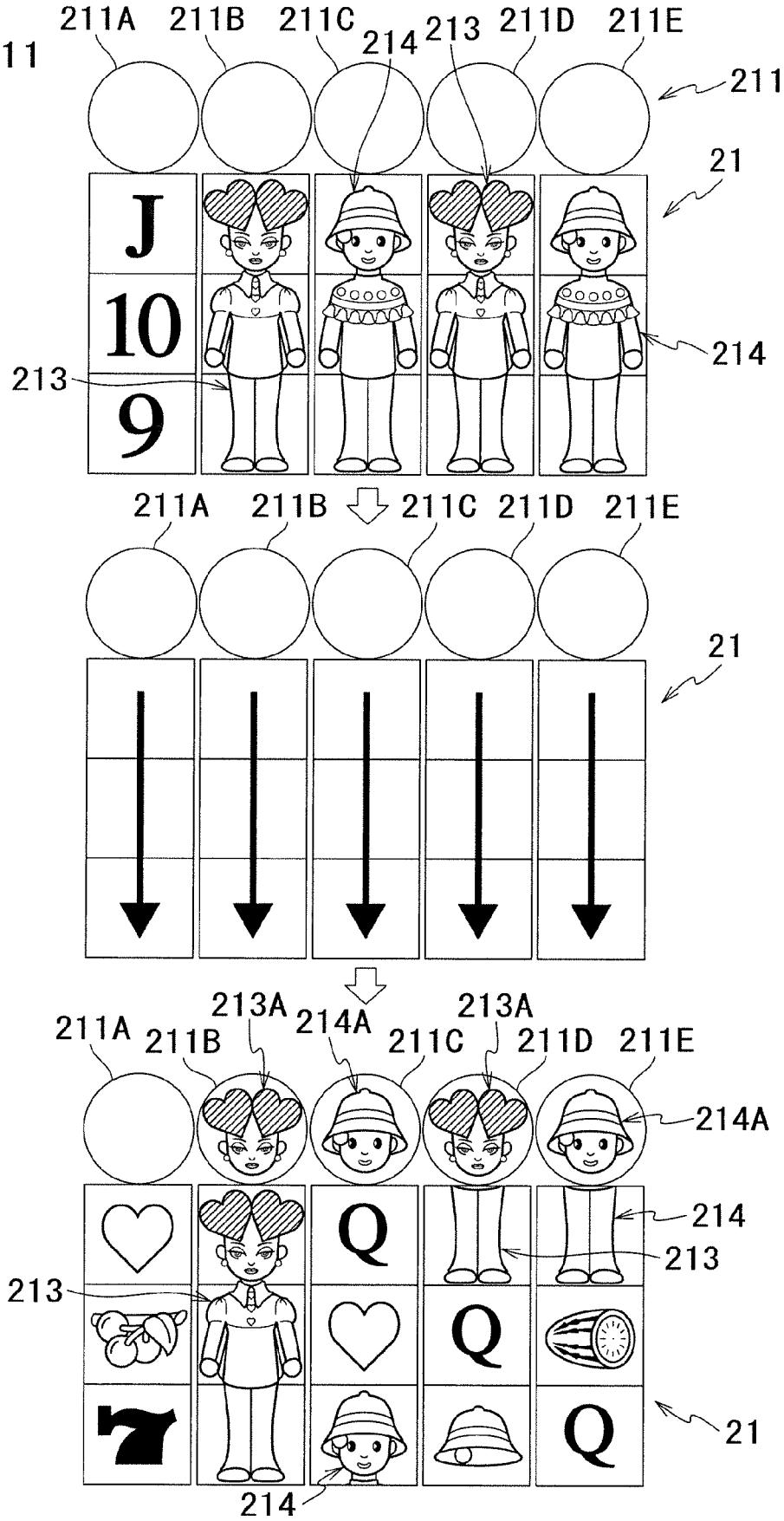
FIG. 11 is an illustrative view of a slot game displayed on a display.

A total of five display areas 211A to 211E are displayed in the character display area 211 displayed at the upper of the symbol display area 21 (with reference to FIG. 11). That is, the five display areas 211A to 211E are displayed outside the symbol display area 21. The five display areas 211A to 211E are arranged corresponding to the upper portions of five first to fifth column areas, respectively. Although details will be described later, characters corresponding to "HEART WILD" and "BELL WILD" rearranged in the first to fifth column areas of the symbol display area 21 are displayed in the five display areas 211A to 211E (with reference to FIG. 11).

(Symbol Columns of the Video Reels)

Next, with reference to FIG. 6, the configuration of the symbol columns included in the video reels 3 of the slot game will be described (corresponding to the random determination table).

As shown in FIG. 6, symbol columns composed of the symbols corresponding to code numbers "0" to "34" are allocated to "REEL 1", "REEL 2", "REEL 3", "REEL 4", and "REEL 5" of the video reels 3, respectively. Normal symbols such as "7", "HEART", "BELL", "WATERMELON", "CHERRY", "ACE (A)", "KING (K)", "QUEEN (Q)", "JACK (J)", "10", "9", a "HEART WILD" (corresponding to the specific symbol) replacing the symbol of "HEART", a "BELL WILD" (corresponding to the specific symbol) replacing the symbol of "BELL", and a "WILD" symbol which is a universal symbol (symbol of almighty) as an alternate of another symbol are included in the types of symbols arranged in each symbol column of the video reels 3.

Here, the "HEART WILD" and "BELL WILD" are sequentially arranged across three code numbers in the corresponding "REEL", and furthermore, the consecutively arranged "HEART WILD" and "BELL WILD" constitute one integral image corresponding to each.

For example, as shown in FIG. 6, in "REEL 2", the "HEART WILD" is consecutively arranged across three code numbers "24" to "26", and as shown in FIG. 11, one integral Heart mascot image 213 corresponding to three consecutively arranged "HEART WILD" is formed. In addition, as shown in FIG. 6, in "REEL 3", the "BELL WILD" is consecutively arranged across three code numbers "28" to "30", and as shown in FIG. 11, one integral Bell mascot image 214 corresponding to three consecutively arranged "BELL WILD" is formed.

(Symbol Combination Table)

Next, with reference to 7, the symbol combination table is illustrated. FIG. 7 is an illustrative view of a symbol combination table used in the slot game according to the present embodiment.

The symbol combination table of the slot game defines the symbol combination (number of symbols) of symbols related to a winning (WIN) and the payout amount (payout). In the slot game, the scrolling of the symbol column of the video reels 3 is stopped, and in an area of the symbol display area 21, which becomes the object of the winning determination by the WAYS BET described above, when a predetermined types of symbols are connected up to a predetermined number from the first column area to the fifth column area, the winning is established. Then, according to the winning, a benefit such as a payout is given to the player.

Basically, for each symbol of "7", "HEART", "BELL", "WATERMELON", "CHERRY", "A", "K", "Q", "J", "10", "9", when symbols of the same type are connected with each other up to 3 (3 Kind), 4 (4 Kind), or 5 (5 Kind) by the WAYS BET from the first column area to the fifth column area in the area which is the object of the winning determination, the winning is established. For the symbol of "WILD", it is substituted for each type of symbol of "7", "HEART", "BELL", "WATERMELON", "CHERRY", "A", "K", "Q", "J", "10", and "9". In addition, the "HEART WILD" replaces the symbol of "HEART". In addition, the "BELL WILD" replaces the symbol of "BELL".

For example, when "WAYS BET 3" is selected, the upper row, the middle row, and the lower row of the first column area, the upper row, the middle row and the lower row of the second column area, the upper row, the middle row and the lower row of the third column area, the middle row of the fourth column area, and the middle row of the fifth column area of the symbol display area 21 become the object of the winning determination (valid). Then, the scrolling of each symbol column of the video reels 3 (REEL 1, REEL 2, REEL 3, REEL 4, REEL 5) is stopped, and when the symbols "7" are respectively stopped in the lower row of the first column area, the upper row of the second column area, and the middle row of the third column area, the symbols "7" are connected with each other up to three from the first column area to the third column area ("LEFT TO RIGHT") to establish a winning ("3 Kind of "7" is established). In this case, referring to the symbol combination table of FIG. 7, "50" is determined as the payout amount of coins. Then, a payout is given based on the determined payout amount of the coins.

In addition, in the slot game, the required bet amount (WAYS BET 1: 1 coin, WAYS BET 2: 3 coins, WAYS BET 3: 7 coins, WAYS BET 4: 15 coins, WAYS BET 5: 25 coins) are determined in each selection of 5 stages of WAYS BET, respectively. In addition, it is also possible to select multiple WAYS BETs in the unit game. For example, when WAYS BET 3 (7 coins) is selected up to three times, 21 coins ("7"×"3"=21) are required for the total bet amount, but when the winning of 3 Kind of "7" is established, "50"×"3"="150" is determined as the payout amount of coins.

[Contents of Program]

Figure 8:
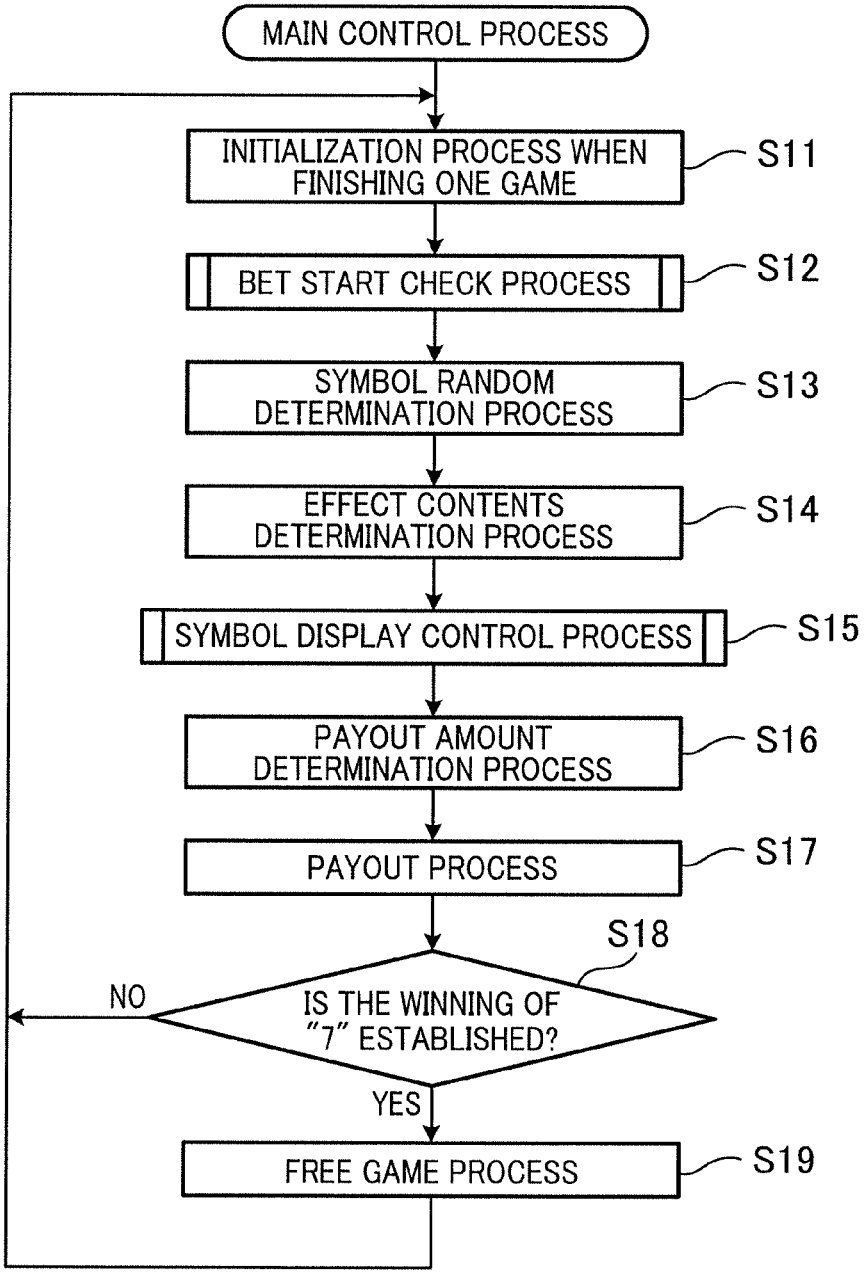
FIG. 8 is a diagram showing a flowchart of a main control process.
Figure 9:
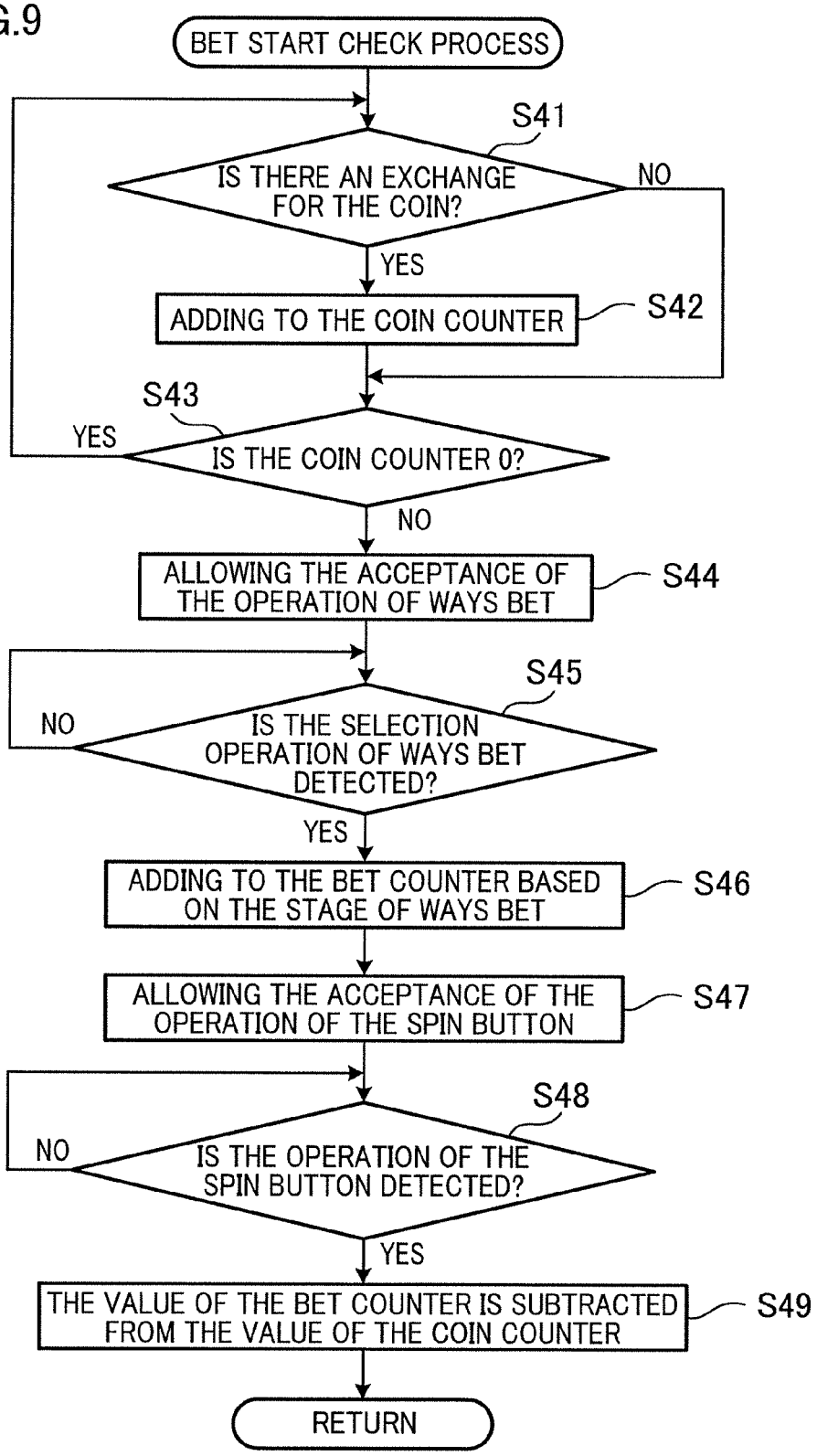
FIG. 9 is a diagram showing a flowchart of a bet start check process.
Figure 10:
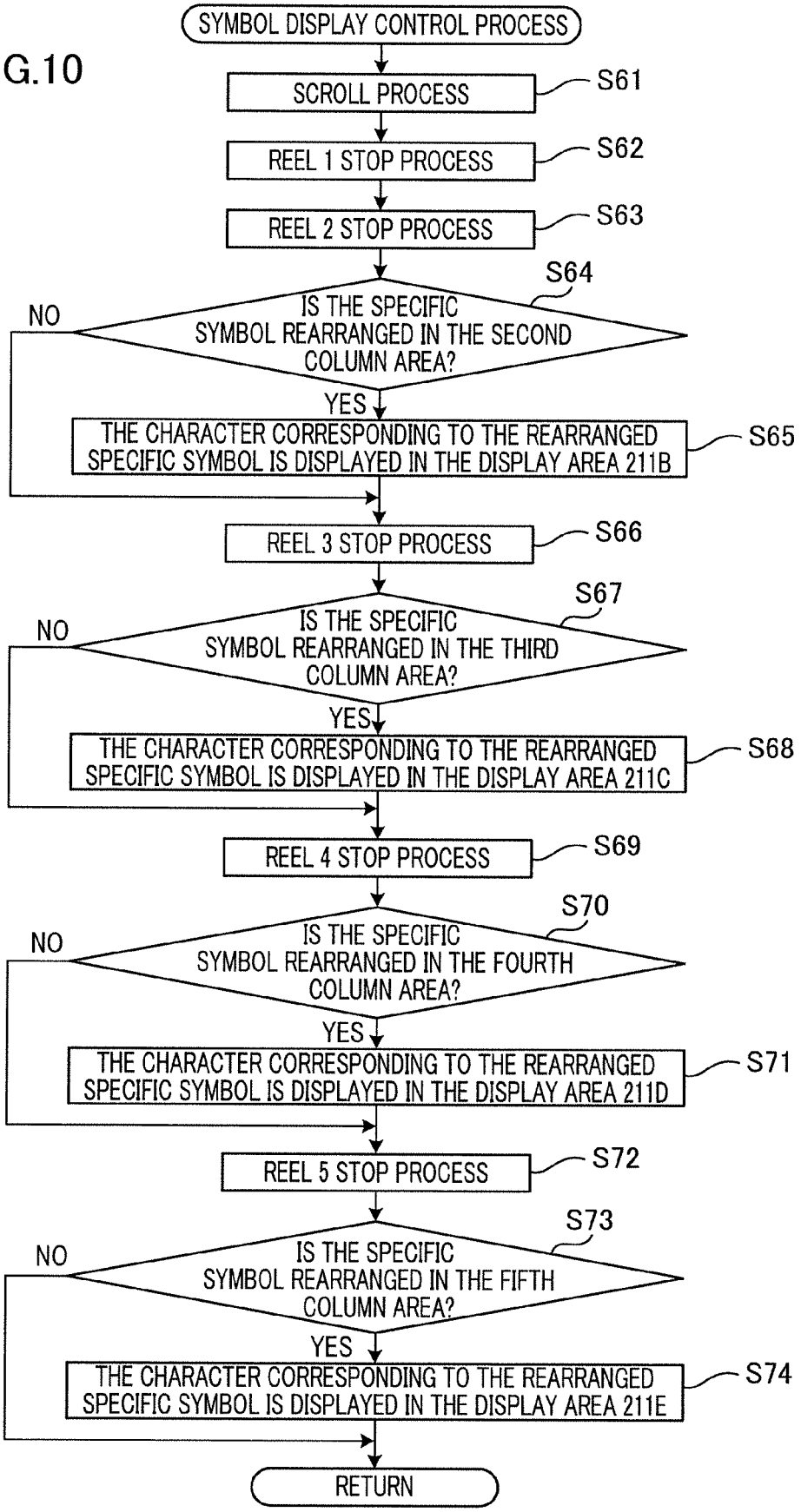
FIG. 10 is a diagram showing a flowchart of a symbol display control process.

Next, a program of a slot game executed by the smartphone 1 will be described with reference to FIG. 8 to FIG. 10.

(Main Control Process)

First, with reference to FIG. 8, the main control process will be described. First, in order to start the slot game, the CPU 101 performs an initialization process when finishing one game (S11). For example, unnecessary data for each unit game in the work area of the flash memory 104, such as the WAYS BET enabled in the previous unit game and the symbol determined to be displayed in the symbol display area 21 by the random determination is cleared.

Next, the CPU 101 performs a bet start check process to be described later (S12). In this process, an input check such as WAYS BET (WAYS BET 1, WAYS BET 2, WAYS BET 3, WAYS BET 4, WAYS BET 5) selected by the touch panel 5 or the like is performed. At this time, as shown in FIG. 4, according to the selection of WAYS BET, in order to distinguish from the area (black frame) which is not the object of the winning determination, the area which is the object of the winning determination in the symbol display area 21 is displayed in a white frame. In this way, it is possible to visually distinguish the area which is the object of the winning determination and the area which is not the object of the winning determination.

Next, the CPU 101 performs a symbol random determination process (S13). In this symbol random determination process, the symbol column of the video reels 3 shown in FIG. 6 is used to determine a to-be-stopped symbol by the random determination from a plurality of symbols arranged in each symbol column (REEL 1, REEL 2, REEL 3, REEL 4, REEL 5) of the video reels 3. The to-be-stopped symbol is data of five symbols of the plurality of symbols constituting each symbol column of the video reels 3 to be displayed in the respective middle rows of the first to fifth row areas of the symbol display area 21. As a result, the 15 symbols displayed in the symbol display area 21 are determined.

For example, in the REEL 1 of the video reels 3, when a code number "1" is selected by the random determination from 26 symbols (code numbers "0" to "25") constituting the symbol column, the symbol of "CHERRY" corresponding to the code number "1" is determined as the to-be-stopped symbol. In addition, in the REEL 2, when a code number "25" is selected by the random determination from 35 symbols (code numbers "0" to "34") constituting the symbol column, the symbol in the middle of "HEART WILD" corresponding to the code number "25" is determined as the to-be-stopped symbol. In addition, in the REEL 3, when a code number "27" is selected by the random determination from 31 symbols (code numbers "0" to "30") constituting the symbol column, the symbol of "HEART" corresponding to the code number "27" is determined as the to-be-stopped symbol. In addition, in the REEL 4, when a code number "30" is selected by the random determination from 34 symbols (code numbers "0" to "33") constituting the symbol column, the symbol of "Q" corresponding to the code number "30" is determined as the to-be-stopped symbol. In addition, in the REEL 5, when a code number "5" is selected by the random determination from 34 symbols (code numbers "0" to "33") constituting the symbol column, the symbol of "WATERMELON" corresponding to the code number "5" is determined as the to-be-stopped symbol.

Then, the CPU 101 stores the five determined to-be-stopped symbols in the symbol storing area provided in the flash memory 104.

Next, the CPU 101 performs an effect contents determination process (S14). The CPU 101 extracts an effect-use random number and determines which one of a plurality of predetermined effect contents by the random determination.

Next, the CPU 101 performs a symbol display control process (S15). The symbol display control process will be described with reference to the flow of FIG. 10. First, as shown in the middle symbol display area 21 in FIG. 11, the CPU 101 starts scrolling each symbol column of the video reels 3 (scroll process: S61).

Then, after the lapse of the predetermined time, the CPU 101 stops the to-be-stopped symbol of REEL 1 determined in the symbol random determination process of S13 in the middle row of the first column area of the symbol display region 21 (REEL 1 stop process: S62). As a result, three symbols including the to-be-stopped symbol are rearranged in the first column area of the symbol display area 21. For example, as described above, in the REEL 1, when the symbol of "CHERRY" corresponding to the code number "1" is determined as the to-be-stopped symbol, in the upper row, the middle row, and the lower row of the first column area of the symbol display area 21, "HEART", "CHERRY", and "7" are respectively rearranged (with reference to the symbol display area 21 in the lower row of FIG. 11).

Then, after the lapse of the predetermined time, the CPU 101 stops the to-be-stopped symbol of REEL 2 determined in the symbol random determination process of S13 in the middle row of the first column area of the symbol display region 21 (REEL 2 stop process: S63). As a result, three symbols including the to-be-stopped symbol are rearranged in the second column area of the symbol display area 21. For example, as described above, in the REEL 2, when the middle symbol of "HEART WILD" corresponding to the code number "25" is determined as the to-be-stopped symbol, in the upper row, the middle row, and the lower row of the second column area of the symbol display area 21, "HEART WILDs" are respectively rearranged (with reference to the symbol display area 21 in the lower row of FIG. 11). In this manner, when the "HEART WILD" is rearranged at the upper row, the middle row, and the lower row of the second column area of the symbol display area 21, a Heart mascot image 213 corresponding to three rows of consecutively arranged "HEART WILD" is displayed at the upper row, the middle row, and the lower row of the second column area of the symbol display area 21.

After the REEL 2 stop process, the CPU 101 determines whether the "HEART WILD" or "BELL WILD" has been rearranged in any of the upper row, the middle row, or the lower row of the second column area of the symbol display area 21 (S64). When the "HEART WILD" or "BELL WILD" is rearranged in any of the upper row, the middle row, and the lower row of the second column area of the symbol display area 21 (S64: YES), the CPU 101 displays a character corresponding to the rearranged "HEART WILD" or "BELL WILD" in the display area 211B (S65). For example, as shown in the symbol display area 21 of the lower row in FIG. 11, when the "HEART WILD" is rearranged at the upper row, the middle row, and the lower row of the second column area of the symbol display area 21, a Heart character 213A corresponding to the "HEART WILD" is displayed in the display area 211B.

Next, when the "HEART WILD" or "BELL WILD" is not rearranged in any of the upper row, the middle row and the lower row of the second column area of the symbol display area 21 (S64: NO) or after a lapse of a predetermined time from the process in S65, the CPU 101 stops the to-be-stopped symbol of REEL 3 determined in the symbol random determination of S13 at the middle row of the third column area of the symbol display area 21 (REEL 3 stop process: S66). As a result, three symbols including the to-be-stopped symbol are rearranged in the third column area of the symbol display area 21. For example, as described above, in the REEL 3, when the symbol of "HEART" corresponding to the code number "27" is determined as the to-be-stopped symbol, in the upper row, the middle row, and the lower row of the third column area of the symbol display area 21, "Q", "HEART", and "BELL WILD" are respectively rearranged (with reference to the symbol display area 21 in the lower row of FIG. 11). In this way, when the "BELL WILD" is rearranged only in the lower row of the third column area of the symbol display area 21, a part (head part) of a Bell mascot image 214 corresponding to the "BELL WILD" is displayed in the lower row of the third column area of the symbol display area 21.

After the REEL 3 stop process, the CPU 101 determines whether the "HEART WILD" or "BELL WILD" has been rearranged in any of the upper row, the middle row, or the lower row of the third column area of the symbol display area 21 (S67). When the "HEART WILD" or "BELL WILD" is rearranged in any of the upper row, the middle row, and the lower row of the third column area of the symbol display area 21 (S67: YES), the CPU 101 displays a character corresponding to the rearranged "HEART WILD" or "BELL WILD" in the display area 211C (S68). For example, as shown in the symbol display area 21 of the lower row in FIG. 11, when the "BELL WILD" is rearranged at the lower row of the third column area of the symbol display area 21, a Bell character 214A corresponding to the "BELL WILD" is displayed in the display area 211C.

Next, when the "HEART WILD" or "BELL WILD" is not rearranged in any of the upper row, the middle row and the lower row of the third column area of the symbol display area 21 (S67: NO) or after a lapse of a predetermined time from the process in S68, the CPU 101 stops the to-be-stopped symbol of REEL 4 determined in the symbol random determination of S13 at the middle row of the fourth column area of the symbol display area 21 (REEL 4 stop process: S69). As a result, three symbols including the to-be-stopped symbol are rearranged in the fourth column area of the symbol display area 21. For example, as described above, in the REEL 4, when the symbol of "Q" corresponding to the code number "30" is determined as the to-be-stopped symbol, in the upper row, the middle row, and the lower row of the fourth column area of the symbol display area 21, "HEART WILD", "Q", and "BELL" are respectively rearranged (with reference to the symbol display area 21 in the lower row of FIG. 11). In this way, when the "HEART WILD" is rearranged only in the upper row of the fourth column area of the symbol display area 21, a part (foot part) of the Heart mascot image 213 corresponding to the "HEART WILD" is displayed in the upper row of the fourth column area of the symbol display area 21.

After the REEL 4 stop process, the CPU 101 determines whether the "HEART WILD" or "BELL WILD" has been rearranged in any of the upper row, the middle row, or the lower row of the fourth column area of the symbol display area 21 (S70). When the "HEART WILD" or "BELL WILD" is rearranged in any of the upper row, the middle row, and the lower row of the fourth column area of the symbol display area 21 (S70: YES), the CPU 101 displays a character corresponding to the rearranged "HEART WILD" or "BELL WILD" in the display area 211D (S71). For example, as shown in the symbol display area 21 of the lower row in FIG. 11, when the "HEART WILD" is rearranged at the upper row of the fourth column area of the symbol display area 21, a Heart character 213A corresponding to the "HEART WILD" is displayed in the display area 211D.

Next, when the "HEART WILD" or "BELL WILD" is not rearranged in any of the upper row, the middle row and the lower row of the fourth column area of the symbol display area 21 (S70: NO) or after a lapse of a predetermined time from the process in S71, the CPU 101 stops the to-be-stopped symbol of REEL 5 determined in the symbol random determination of S13 at the middle row of the fifth column area of the symbol display area 21 (REEL 5 stop process: S72). As a result, three symbols including the to-be-stopped symbol are rearranged in the fifth column area of the symbol display area 21. For example, as described above, in the REEL 5, when the symbol of "WATERMELON" corresponding to the code number "5" is determined as the to-be-stopped symbol, in the upper row, the middle row, and the lower row of the fifth column area of the symbol display area 21, "BELL WILD", "WATERMELON", and "Q" are respectively rearranged (with reference to the symbol display area 21 in the lower row of FIG. 11). In this way, when the "BELL WILD" is rearranged only in the upper row of the fifth column area of the symbol display area 21, a part (foot part) of the Bell mascot image 214 corresponding to the "BELL WILD" is displayed in the upper row of the fifth column area of the symbol display area 21.

After the REEL 5 stop process, the CPU 101 determines whether the "HEART WILD" or "BELL WILD" has been rearranged in any of the upper row, the middle row, or the lower row of the fifth column area of the symbol display area 21 (S73). When the "HEART WILD" or "BELL WILD" is rearranged in any of the upper row, the middle row, and the lower row of the fifth column area of the symbol display area 21 (S73: YES), the CPU 101 displays a character corresponding to the rearranged "HEART WILD" or "BELL WILD" in the display area 211E (S74). For example, as shown in the symbol display area 21 of the lower row in FIG. 11, when the "BELL WILD" is rearranged at the upper row of the fifth column area of the symbol display area 21, the Bell character 214A corresponding to the "BELL WILD" is displayed in the display area 211E.

On the other hand, when the "HEART WILD" or "BELL WILD" is not rearranged in any of the upper row, the middle row, and the lower row of the fifth column area of the symbol display area 21 (S73: NO) or after the process of S74, the symbol display control process is terminated.

According to the symbol display control process, for example, as described above, when the "HEART WILD" is rearranged at the upper row, the middle row, and the lower row of the second column area of the symbol display area 21, a Heart mascot image 213 corresponding to three rows of consecutively arranged "HEART WILD" is displayed at the upper row, the middle row, and the lower row of the second column area of the symbol display area 21. As a result, it is possible to clearly appeal to the player that the "HEART WILD" has been rearranged in the symbol display area 21.

On the other hand, as described above, when the "HEART WILD" is rearranged only in the upper row of the fourth column area of the symbol display area 21, only a part (foot part) of the Heart mascot image 213 corresponding to the "HEART WILD" is displayed in the upper row of the fourth column area of the symbol display area 21. Likewise, when the "BELL WILD" is rearranged only in the upper row of the fifth column area of the symbol display area 21, only a part (foot part) of the Bell mascot image 214 corresponding to the "BELL WILD" is displayed in the upper row of the fifth column area of the symbol display area 21. As a result, as shown in the symbol display area 21 of the lower row in FIG. 11, only a part (foot part) of the Heart mascot image 213 and a part (foot part) of the Bell mascot image 214 appear to be similar with each other in appearance, and the player may be unable to clearly distinguish whether the "HEART WILD" is rearranged or the "BELL WILD" is rearranged.

However, in the above symbol display control process, when the "HEART WILD" is rearranged at the upper row of the fourth column area of the symbol display area 21, a Heart character 213A corresponding to the "HEART WILD" is displayed in the display area 211D. In addition, when the "BELL WILD" is rearranged at the upper row of the fifth column area of the symbol display area 21, the Bell character 214A corresponding to the "BELL WILD" is displayed in the display area 211E. In this manner, only when looking at the type of character displayed in the display areas 211A to 211E of the character display area 211, it is possible to clearly appeal to the player so that the player can recognize at a glance whether the symbol rearranged in the first to fifth column areas of the symbol display area 21 is the "HEART WILD" or the "BELL WILD". Thereby, it allows the player to smoothly execute a slot game, and there is an advantage that the possibility of being able to induce the player to execute the slot game can be increased.

By performing the symbol display control process (S15), 15 symbols are rearranged in the symbol display area 21 (with reference to the symbol display area 21 of the lower row in FIG. 11).

Next, the CPU 101 performs a payout amount determination process (S16). In this process, based on the symbol combination table of slot games (with reference to FIG. 7) stored in the flash memory 104, it is determined whether symbols rearranged in the symbol display area 21 are connected up to the predetermined number from the first column area to the fifth column area in the area which is the object of the winning determination by the WAYS BET described above to establish a winning. Then, according to the winning, a benefit such as a payout is given. The given payout is stored in the payout amount storage area provided in the flash memory 104.

For example, when "WAYS BET 4" is selected, the upper row, the middle row, and the lower row of the first column area, the upper row, the middle row and the lower row of the second column area, the upper row, the middle row and the lower row of the third column area, the upper row, the middle row and the lower row of the fourth column area, and the middle row of the fifth column area of the symbol display area 21 become the object of the winning determination (valid). Then, as shown in the symbol display area 21 of the lower row in FIG. 11, when the symbol of "HEART" is rearranged at the upper row of the first column area, the "HEART WILD" is rearranged at the upper row, middle row, and lower row of the second column area, the symbol of "HEART" is rearranged at the middle row of the third column area, and the "HEART WILD" is rearranged at the upper row of the fourth column area, as shown in the symbol display area 21 of the upper row in FIG. 12, three consecutive winnings are established in which the symbols of "HEART" are consecutively connected up to four across the first column area to the fourth column area ("LEFT TO RIGHT").

Figure 12:
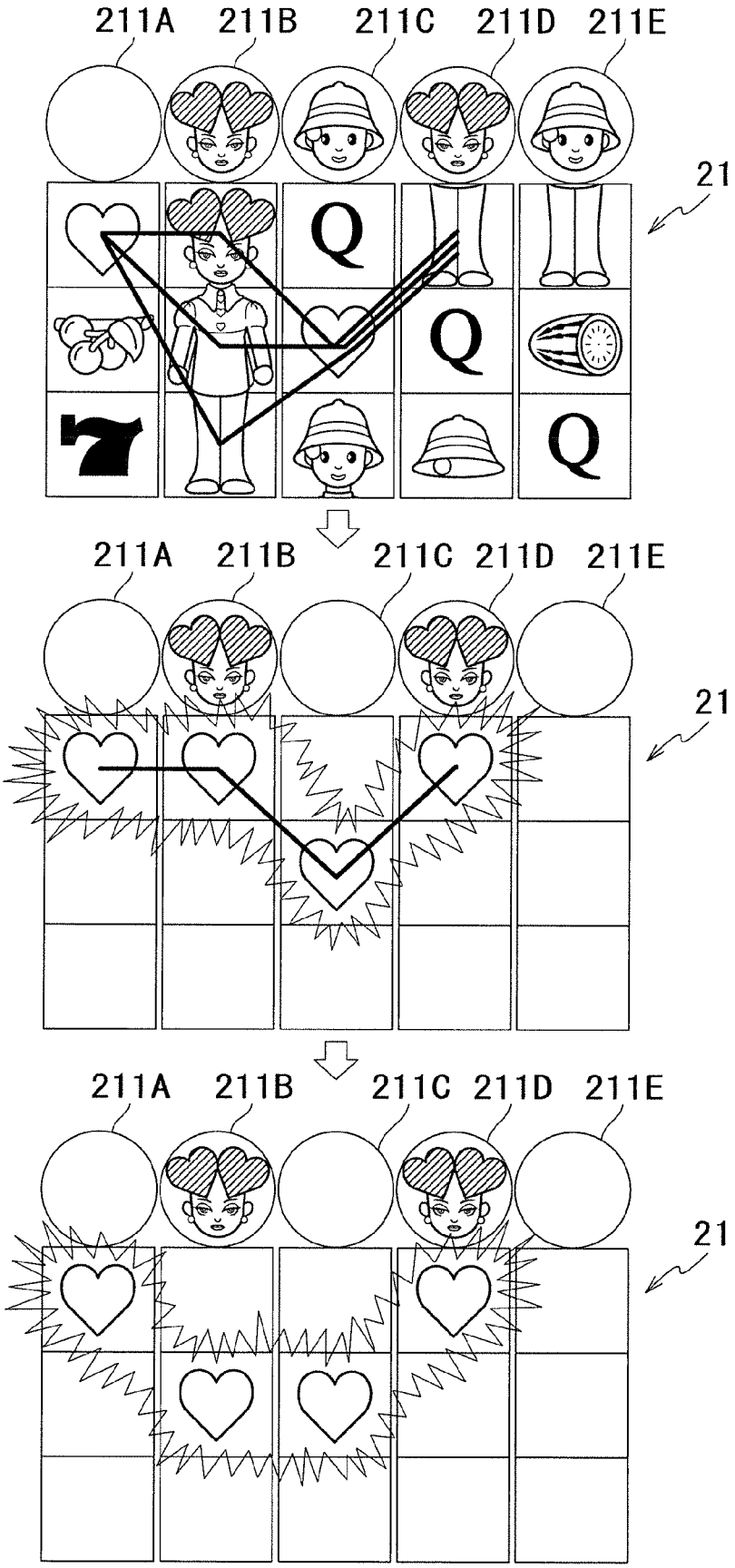
FIG. 12 is an illustrative view of a slot game displayed on a display.
Figure 13:
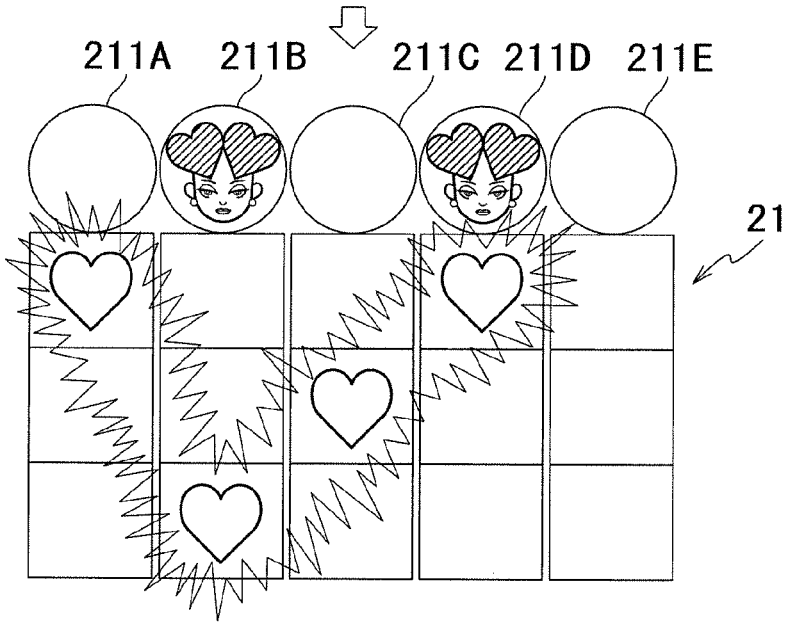
FIG. 13 is an illustrative view of a slot game displayed on a display.

At this time, in order to visually confirm that three winnings of 4 Kind of "HEART" are established, as shown in the symbol display area 21 of the middle row in FIG. 12, the symbol of "HEART" at the upper row of the first column area, the symbol of "HEART WILD" at the upper row of the second column area, the symbol of "HEART" at the middle row of the third column area, and the "HEART WILD" at the upper row of the fourth column area are lighted and then flashed and displayed. Next, as shown in the symbol display area 21 of the lower row in FIG. 12, the symbol of "HEART" at the upper row of the first column area, the symbol of "HEART WILD" at the middle row of the second column area, the symbol of "HEART" at the middle row of the third column area, and the "HEART WILD" at the upper row of the fourth column area are lighted and then flashed and displayed. Finally, as shown in the symbol display area 21 of FIG. 13, the symbol of "HEART" at the upper row of the first column area, the symbol of "HEART WILD" at the lower row of the second column area, the symbol of "HEART" at the middle row of the third column area, and the "HEART WILD" at the upper row of the fourth column area are lighted and then flashed and displayed.

Then, when three winnings of 4 Kind of "HEART" are established, the symbol combination table of FIG. 7 is referred to, and it is determined that "200"×"3"="600" coins are given as a payout and stored in the payout amount storage area provided in the flash memory 104.

Next, the CPU 101 performs a payout process (S17). The CPU 101 adds the value stored in the payout amount storage area to the value of the coin number counter provided in the flash memory 104. For example, when "600" is stored in the payout amount storage area in the payout amount determination process of S16, "600" is added to the value of the coin number counter.

Next, the CPU 101 determines whether or not a winning of "7" (3 Kind of "7", 4 Kind of "7", 5 Kind of "7") is established (S18). Then, when the winning of "7" is established (S18: YES), the CPU 101 performs a free game process (S19). In this free game process, the player can perform the slot game for twenty times without consuming any coin.

On the other hand, if the winning of "7" is not established (S18: NO), or after the process of S19, the process turns to S11.

(Bet Start Check Process)

Next, with reference to FIG. 9, the bet start check process will be described.

First, based on the information from the server 100, the CPU 101 determines whether or not there has been an exchange from a credit possessed by a player (a out-of-game currency that can be used outside the game) to a coin that can be used in the slot game (in-game currency) (S41).

If it is determined that the coin has been exchanged (S41: YES), the CPU 101 adds the number of exchanged coins to the value of the coin number counter provided in the flash memory 104 (S42).

After the process of S 42 or when it is determined that there is no exchange to coins in S41 (S 41: NO), the CPU 101 determines whether the value stored in the coin counter is "0" or not (S43). When it is determined that the value stored in the coin counter is "0" (S43: YES), the CPU 101 displays on the display 120 a message prompting the player to exchange coins from the credits possessed by the player, and highlights the image of the shop button 246 of the operation display area 24. Thereafter, the process proceeds to S41. In addition, when the image of the shop button 246 is touched, it is possible to access the server 100 from the smartphone 1 and move to the shop in which the credit can be exchanged for the coin.

On the other hand, when it is determined that the value stored in the coin counter is not "0" (S43: NO), the CPU 101 allows to accept the selection of the five stages of WAYS BET (WAYS BET 1, WAYS BET 2, WAYS BET 3, WAYS BET 4, WAYS BET 5) by pressing the touch panel 5 of the "+" button and the "−" button of the bet button 244 (with reference to FIG. 1) (S44). The area as the object of the winning determination is determined from the 15 areas in 5 columns×3 rows of the symbol display area 21 by selecting five stages of the WAYS BET (with reference to FIG. 4).

Next, the CPU 101 determines whether or not a selection operation (pressing) of five stages of WAYS BET (WAYS BET 1, WAYS BET 2, WAYS BET 3, WAYS BET 4, WAYS BET 5) is detected (S45). If the selection operation of WAYS BET is not detected (S45: NO), waiting for the selection operation.

On the other hand, when the selection operation of five stages of WAYS BET (WAYS BET 1, WAYS BET 2, WAYS BET 3, WAYS BET 4, WAYS BET 5) is detected (S45: YES), the CPU 101 adds the value of coins necessary for WAYS BET (1 coin if it is WAYS BET 1, 3 coins if WAYS BET 2, 7 coins if WAYS BET 3, 15 coins if WAYS BET 4, 25 coins if WAYS BET 5) to the value of the bet counter provided in the flash memory 104 (S46).

Next, after process of S46, the CPU 101 allow the acceptance of operation of the spin button 241 (S47).

After S47, the CPU 101 determines whether or not the operation of the spin button 241 is detected (S48). When the CPU 101 determines that the operation of the spin button 241 is not detected (S48: NO), waiting for the operation of the spin button 241.

On the other hand, when it is determined that the operation of the spin button 241 is detected (S48: YES), the CPU 101 subtracts the value of the bet counter calculated in S46 from the value of the coin counter (S49). Thereafter, the bet start check process is terminated.

(Other Embodiment)

In the above embodiment, the characters corresponding to the "HEART WILD" and the "BELL WILD" are displayed in the five display areas 211A to 211E respectively, but only if the place to display is outside the symbol display area 21, it may be the game information display area 22 or the effect display area 23.

Although the embodiment of the present invention has been described above, it is merely a specific example, and the present invention is not particularly limited, and the specific configuration of each means and the like can be appropriately designed and changed. In addition, the effects described in the embodiments of the present invention are merely a list of the most preferable effects produced by the present invention, and the effects of the present invention are not limited to those described in the embodiments of the present invention.

What is claimed is:

1. An information processor comprising:

a display for displaying a symbol display area in which a plurality of symbols are able to be displayed; and a controller programmed to execute:

receiving one or more input patterns from a user;

determining a plurality of selected sequences of symbols to be displayed in the symbol display area by random determination;

for each selected sequence of symbols, displaying the selected sequence of symbols in the symbol display area;

determining whether the selected sequence of symbols includes a portion of a specific sequence of symbols among a plurality of specific sequences of symbols; and displaying a character corresponding to the specific sequence of symbols outside the symbol display area when the selected sequence of symbols includes the portion of the specific sequence of symbols; and for each input pattern, determining whether the input pattern matches one or more predetermined sequences of symbols; and displaying information indicating the input pattern matches the one or more predetermined sequences of symbols when the input pattern matches the one or more predetermined sequences of symbols.

2. An information processor comprising:

a display for displaying a symbol display area in which a plurality of symbols are rearrangeable, the symbol display area being arranged in a matrix including a plurality of columns and a plurality of rows, a storage device for storing a random determination table including the plurality of symbols; and a controller programmed to execute:

receiving one or more input patterns from a user;

determining a plurality of selected sequences of symbols to be displayed in the symbol display area based on the random determination table;

for each selected sequence of symbols, displaying the selected sequence of symbols in the symbol display area;

determining whether the selected sequence of symbols includes a portion of a specific sequence of symbols among a plurality of specific sequences of symbols; and displaying a character corresponding to the specific sequence of symbols outside the symbol display area when the selected sequence of symbols includes the portion of the specific sequence of symbols among the plurality of specific sequences of symbols; and for each input pattern, determining whether the input pattern matches one or more predetermined sequences of symbols; and displaying information indicating the input pattern matches the one or more predetermined sequences of symbols when the input pattern matches the one or more predetermined sequences of symbols.

3. The information processor according to claim 2, wherein the random determination table includes one or more specific sequences of symbols for each column, and each specific sequence of symbols constitutes one image.

4. A game control method comprising the steps of:

receiving, by an information processor, one or more input patterns from a user;

determining, by a controller of the information processor, a plurality of selected sequences of symbols to be displayed in a symbol display area of a display of the information processor based on random determination;

for each selected sequence of symbols, displaying the selected sequence of symbols in the symbol display area;

determining whether the selected sequence of symbols includes a portion of a specific sequence of symbols among a plurality of specific sequences of symbols; and displaying a character corresponding to the specific sequence of symbols outside the symbol display area when the selected sequence of symbol includes the portion of the specific sequence of symbols among the plurality of specific sequences of symbols; and for each input pattern, determining whether the input pattern matches one or more predetermined sequences of symbols; and displaying information indicating the input pattern matches the one or more predetermined sequences of symbols when the input pattern matches the one or more predetermined sequences of symbols.

5. A non-temporary recording medium storing a game program executed by a computer of an information processor, the game program controlling the computer to perform:

receiving one or more input patterns from a user;

determining a plurality of selected sequences of symbols to be displayed in a symbol display area of a display of the information processor based on random determination;

for each selected sequence of symbols, displaying the selected sequence of symbols in the symbol display area;

determining whether the selected sequence of symbols includes a portion of a specific sequence of symbols among a plurality of specific sequences of symbols; and displaying a character corresponding to the specific sequence of symbols outside the symbol display area when the selected sequence of symbol includes the portion of the specific sequence of symbols among the plurality of specific sequences of symbols; and for each input pattern, determining whether the input pattern matches one or more predetermined sequences of symbols; and displaying information indicating the input pattern matches the one or more predetermined sequences of symbols when the input pattern matches the one or more predetermined sequences of symbols.

6. The information processor according to claim 1, wherein a first portion of a first specific sequence of symbols of the plurality of selected sequences of symbols is visually indistinguishable from a second portion of a second specific sequence of symbols of the plurality of selected sequences of symbols.

7. An information processor comprising:

a display which displays a symbol display area in which symbols are rearrangeable and a plurality of columns and a plurality of rows intersect with one another in a matrix;

a symbol display processing unit, including a central processing unit (CPU), which provides a first pattern in which a first single image is recognizable when first specific symbols are successively arranged in a column on the display and a second pattern in which the first single image is not recognizable when only a portion of the first specific symbols are arranged in the column on the display; and a button switch used for starting a slot game displayed on the display, wherein specific symbols of multiple types are provided so that a single image is recognizable when specific symbols of one type are successively arranged, wherein the symbol display processing unit is programmed to provide a second single image different from the first single image when second specific symbols are successively arranged, and wherein the symbol display processing unit performs:

when receiving a game start signal from the button switch, rearranging the symbols to be displayed in the matrix on the display; and when one or more specific symbols of a same type are displayed in a column on the display, displaying a character image corresponding to a single image formed from the one or more specific symbols of the same type outside the symbol display area.

8. A system, comprising:

one or more displays;

a switch;

one or more processors; and memory including instructions that, when executed by the one or more processors, cause the system to perform:

rearranging a plurality of symbols in response to receiving a signal from the switch, the plurality of symbols including a plurality of specific sequences of symbols that each form a single image when successively arranged;

displaying, in a symbol display area of the one or more displays, a plurality of selected sequences of symbols, the plurality of selected sequences of symbols including a first portion of a first specific sequence of symbols that form a first single image and a second portion of a second specific sequence of symbols that form a second single image, the first portion being visually indistinguishable from the second portion;

displaying, outside the symbol display area of the one or more displays, a first specific symbol corresponding to the first single image and a second specific symbol corresponding to the second single image; and displaying, on the one or more displays, information indicating one or more of the plurality of selected sequences of symbols matches one or more predetermined sequences of symbols.

* * * * *